US007281962B2

(12) United States Patent
Dolzer et al.

(10) Patent No.: US 7,281,962 B2
(45) Date of Patent: Oct. 16, 2007

(54) ARRANGEMENT FOR MOUNTING A LUG ON A SCREW

(75) Inventors: Norbert Dolzer, Velden/Vils (DE); Frank Heissler, Eberdingen (DE)

(73) Assignee: Lisa Dräxlmaier GmbH, Vilsbiburg (DE)

( * ) Notice: Subject to any disclaimer, the term of this patent is extended or adjusted under 35 U.S.C. 154(b) by 149 days.

(21) Appl. No.: 11/272,440

(22) Filed: Nov. 10, 2005

(65) Prior Publication Data

US 2006/0239794 A1 Oct. 26, 2006

(30) Foreign Application Priority Data

Nov. 12, 2004 (DE) ..... 10 2004 054 782

(51) Int. Cl.
*H01R 11/11* (2006.01)

(52) U.S. Cl. ..... 439/883; 439/801; 411/81

(58) Field of Classification Search ..... 439/808–809, 439/727, 813, 190, 314, 883, 801; 411/81, 411/190

See application file for complete search history.

(56) References Cited

U.S. PATENT DOCUMENTS 4,832,629 A * 5/1989 Sasaki et al. ..... 439/792
5,413,500 A * 5/1995 Tanaka ..... 439/521
5,548,164 A * 8/1996 Hillard et al. ..... 307/10.3
6,027,382 A * 2/2000 Reindl et al. ..... 439/793
6,042,431 A * 3/2000 Hayakawa ..... 439/801
6,532,627 B2 * 3/2003 Audisio ..... 16/334
7,125,295 B2 * 10/2006 Zhao et al. ..... 439/883

FOREIGN PATENT DOCUMENTS

| | | | |
|---|---|---|---|
| EP | 0487365 | A1 | 5/1992 |
| EP | 0533421 | B1 | 11/1995 |
| EP | 0670612 | B1 | 4/2000 |
| FR | 2693842 | A1 | 1/1994 |
| JP | 2002-050417 | A | 2/2002 |

* cited by examiner

*Primary Examiner*—Michael C. Zarroli
(74) *Attorney, Agent, or Firm*—Wolf, Greenfield & Sacks, P.C.

(57) ABSTRACT

A prearrangement for mounting lugs (12) on a retaining screw (24) includes a distributor (10) and at least two lugs (12) each with a fixing hole (13). The lugs are each inserted in the distributor in such a way that the fixing holes are substantially in alignment with each other. A mounting aid (16) is connected detachably to the distributor and has a protruding centering element (20) having a cross section substantially corresponding to the cross section of the retaining screw. The centering element passes through the fixing holes in the lugs. The end (30) of the centering element facing the retaining screw has an engagement section for engagement with the screw.

21 Claims, 7 Drawing Sheets

ARRANGEMENT FOR MOUNTING A LUG ON A SCREW

FIELD OF THE INVENTION

Figure 2:
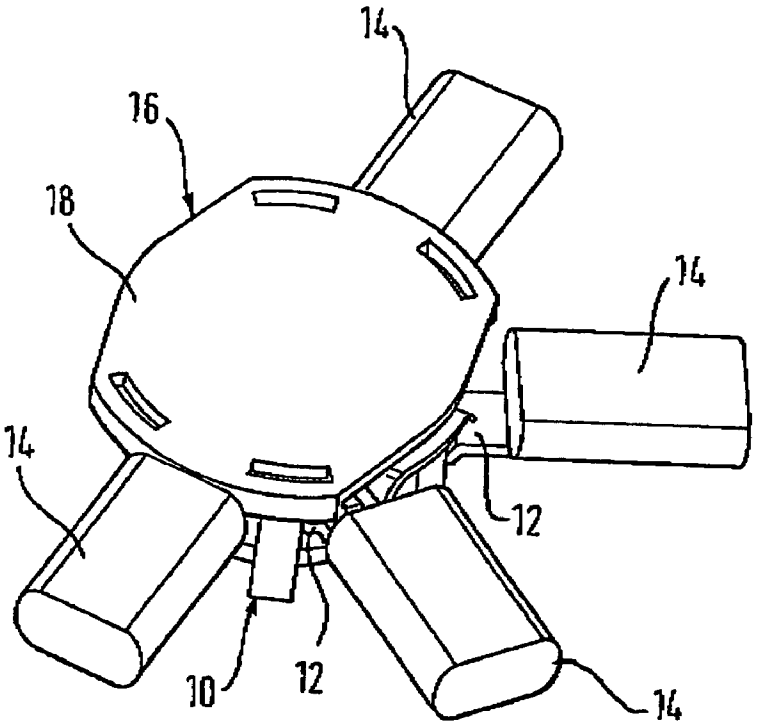

The present invention relates to the mounting of lugs on a retaining screw, and thereby in particular to a prearrangement, a mounting aid and a corresponding method.

The lugs are in particular earthing cable lugs, which are to be mounted on an earthing screw or welding screw. In particular, the present invention relates to use in motor vehicles.

PRIOR ART

It is known from the prior art how to mount earthing cable lugs with a distributor on a welding screw or earthing screw in a motor vehicle. The lugs in the prior art have a fixing hole and are, for example, connected by means of a crimping to an electrical cable. The distributor in the prior art ensures that several lugs with fixing holes in alignment with each other can be mounted on an earthing screw without there being any spatial offset of the earthing cable lugs due to the superposition of the crimp sections or cables. Instead, in mounted condition, the distributor enables the earthing cable lugs with the cables to extend away from the earthing screw in different directions.

In the prior art, the lugs are mounted in such a way that at first the distributor is placed on the earthing screw. Then the earthing cable lugs are led to the earthing screw and inserted in the distributor. Then, the lugs are fastened to the earthing screw by means, for example, of a nut.

One example of prior art of this kind is disclosed in EP-A-0 533 421.

However, it has been found to be problematical with the mounting of earthing cable lugs that in the case of a vehicle's cable tree with a plurality of lugs, during the mounting, the fitter always mounts all lugs intended for an earthing screw. Occasionally, the fitter will oversee a lug, since the number of lugs varies with each vehicle according to how it is equipped. In addition, in the case of a plurality of lugs to be attached to a common earthing screw, the mounting process is complex, since they have to be "threaded" onto the retaining screw individually in sequence and then "fanned out". It is only by means of the fanning out that it is ensured that the lugs are not superimposed on each other and that the subsequent screwing process can be performed with a high degree of operational safety.

SUMMARY OF THE INVENTION

The technical object on which the present invention is based is to rectify the aforementioned disadvantages of the prior art. Consequently, the object of the present invention is to provide a prearrangement for mounting lugs on a retaining screw and/or a mounting aid for this purpose, by means of which all the lugs which are intended for a retaining screw can be combined on the line set or cable tree and by means of which the mounting process can be simplified. In addition, the object of the present invention consists in providing a method of mounting lugs on a retaining screw, which simplifies the mounting process for mounting lugs on a retaining screw, prevents defective mounting and ensures the mounting of all the lugs located on the cable tree on the vehicle body.

This object is achieved by a prearrangement with the features of claim 1 and a mounting aid with the features of claim 2. In addition, the method according to the invention is defined in claims 15, 16 and 17.

Advantageous further developments of the present invention are specified in the dependent claims.

The fundamental idea behind the present invention consists in combining the lugs, which are provided on the cable tree of a motor vehicle and intended for an earthing screw, at the stage of the premounting of the cable tree with a prearrangement so as to simplify the mounting of the lugs on the earthing screw in such a way that all lugs can be pushed more or less simultaneously onto the earthing screw.

Thus, the prearrangement for mounting lugs on a retaining screw according to the present invention comprises a distributor, at least two lugs with one fixing hole, whereby the lugs are each inserted in the distributor in such a way that the fixing holes are substantially in alignment with each other. In addition, the lugs are also connected to an electrical cable by an optional means of connection. The expression that the fixing holes are "substantially" in alignment with each other should be understood as meaning that in the event of the fixing holes in the different lugs having different cross sections, these fixing holes cannot be exactly in alignment with each other. For example, angular and round cross sections may be superimposed although they cannot be in exact alignment with each other due to their cross-sectional shapes. In addition, the angular cross sections could also be offset in such a way that they are not in exact alignment with each other. Therefore, the only essential thing is, for example, that centre axes of the fixing holes are in alignment and are oriented so that the lugs may be placed on the retaining screw together. However, advantageously, the cross sections of the fixing holes in the lugs are substantially of an identical and circular design so that exact alignment is possible. In addition, the prearrangement according to the present invention comprises a mounting aid to which the distributor is connected in a detachable way and which has a protruding centring element. The cross section of the centring element substantially corresponds to the cross section of the retaining screw. In addition, the centring element passes through the, i.e. all, fixing holes in the lugs provided in the prearrangement. However, the cross section of the centring element does not have to correspond exactly to the cross section of the retaining screw. Instead, this is primarily dependent upon the design of the fixing holes in the lugs. If the cross section of these is larger than the cross section of the retaining screw, the cross section of the centring element can also be larger than the cross section of the retaining screw. If the cross sectional shape selected for the fixing holes is different, i.e. rectangular, for example, from that selected for the retaining screw, e.g. circular, the centring element can also have a rectangular cross section. In any case, however, the fixing holes must be designed so that the lugs can be pushed over the retaining screw. Advantageously, the cross section of the centring element will correspond to the cross section of the retaining screw, whereby both the retaining screw and the centring element have a circular design. The end of the centring element facing the retaining screw also has an engaging section for engaging with the retaining screw. In other words, the end of the centring element which is brought into connection with the retaining screw is designed to permit the prearrangement to be placed over the centring element on the retaining screw.

In addition, the present invention proposes a mounting aid for mounting lugs together with a distributor on a retaining screw. The mounting aid according to the present invention comprises a basic element, a centring element which is firmly connected to the basic element, which at its free end has an engagement section for engagement with the retaining screw and with a cross section substantially corresponding to the cross section of the retaining screw. In addition, an interlocking device is provided to connect the mounting aid in a detachable way to the distributor. The interlocking device can hereby be an active element, such as, for example, a snap-in fastener, or a passive element, such as, for example, a recess, a bead or an edge. Otherwise, the statements relating to the prearrangement apply equally to the mounting aid.

According to one advantageous further development of the present invention, the mounting aid's engagement section is an inner cone. This is in particular preferable because the retaining screw, and in particular the earthing screw, in a motor vehicle is currently designed with a chamfer at its upper end, i.e. a blunt outer cone. There is no need, therefore, for any remodeling of the earthing screws used so far in motor vehicles, but the centring element is only designed so that the inner cone fits on the given outer cone of the retaining screw in order to bring the centring element into engagement with the retaining screw.

According to one embodiment of the present invention, the mounting aid has snap-in fasteners, which may be brought into engagement with the distributor in order to achieve the detachable connection of the mounting aid with the distributor. Hereby, the snap-in fasteners can either be designed so detachment is possibly by means of a purely translatory movement of the mounting aid towards the distributor or so that a tool, such as, for example, a screwdriver, is required in order to release the latching. Alternatively, the distributor may also have snap-in fasteners which may be brought into engagement with the mounting aid.

Advantageously, the snap-in fasteners have a sloping contact surface and the snap-in fasteners reach behind the mounting aid or the distributor in such a way that, as already mentioned, the interlocking is released by a movement of the distributor relative to the mounting aid, i.e. the snap-in fasteners are disengaged from the mounting aid or the distributor by the movement of the distributor relative to the mounting aid. This has the advantage that during the mounting no tool is required at the retaining screw, but the prearrangement is placed with one hand over the centring element on the retaining screw and the other hand is used to execute the movement of the distributor relative to the mounting aid in order to release the mounting aid from the distributor and place the lugs together with the distributor onto the retaining screw.

The mounting aid in the present invention is an element that is only required for mounting the lugs with the distributor and is not needed after the mounting. Therefore, it is advantageous for this element to have an inexpensive design. According to one advantageous embodiment of the present invention, therefore, the mounting aid is an injection-moulded part.

Alternatively or additionally thereto, it is also conceivable to use the mounting aid several times, i.e. after the mounting of the lugs, the mounting aid is re-used in a new additional prearrangement.

According to an advantageous further development of the prearrangement in the present invention, the distributor comprises a basic element on which are provided several separating elements in order to define passage openings. The lugs are run through these passage openings so that the cables connected to the lugs extend from the centring element or later from the retaining screw in different directions. This is an effective way of preventing the lugs, during the screwing process, from lying on top of each other in such a way that there is an offset in the axial direction of the retaining screw.

By means of the design of the basic element, the passage openings can define already substantially closed passage openings. Advantageously, the passage openings are, however, open on the side facing away from the basic element to facilitate the insertion of the lugs. In order to prevent the cables or lugs being pushed out of the passage openings during and after the mounting, the distributor advantageously comprises a sealing element which seals the passage openings on the side facing away from the basic element and which is connected to the basic element.

According to an advantageous further development, the sealing element is connected to the basic element by a snap-in connection.

With this embodiment, if the distributor has snap-in fasteners to connect the distributor to the mounting aid, the sealing element can also have snap-in fasteners.

Advantageously, the distributor has at least two passage openings separated from each other, whereby the at least two lugs each pass through one of the passage openings.

In addition, it preferred that, as mentioned above, the fixing holes substantially correspond to the cross section of the retaining screw.

It is currently the practice in the automobile industry to install a completely premounted cable tree, which is usually supplied by the automobile supplier in the motor vehicle on the (main) assembly line. Preferably, the prearrangement in the present invention is already mounted on the premounted cable tree.

In addition to the prearrangement and the mounting aid, the present invention also proposes a method of mounting lugs on a retaining screw which may be divided into a premounting process at the automobile supplier and a final mounting process on the (main) assembly line.

The overall method comprises as the premounting stage the steps of inserting at least two lugs in a distributor, so that the fixing holes in the lugs are substantially in alignment with each other, and the detachable mounting of a mounting aid with a centring element on the distributor, so that the centring element passes through the fixing holes.

In the final mounting process in the method according to the invention, the distributor with the mounting aid and the lugs is placed on the retaining screw, whereby the centring element comes into engagement with the retaining screw. After this, the lugs with the distributor are transferred or pushed by the centring element onto the retaining screw, whereby the mounting aid is released from the distributor. This release may be achieved on the one hand by means of a tool, but is advantageously performed (see above) automatically by the translatory movement of the distributor with the lugs relative to the mounting aid. Finally, the lugs are secured, for example with a nut, on the retaining screw e.g. screwed.

The statements relating to the prearrangement also apply analogously to the method.

Other features, further embodiments and advantages of the present invention may be derived from the following description of examples of embodiments.

SHORT DESCRIPTION OF THE DRAWINGS

The following description of the examples of embodiments refers to the attached drawings in which the same reference numbers in the different views and embodiments designate the same or similar elements.

Figure 1:
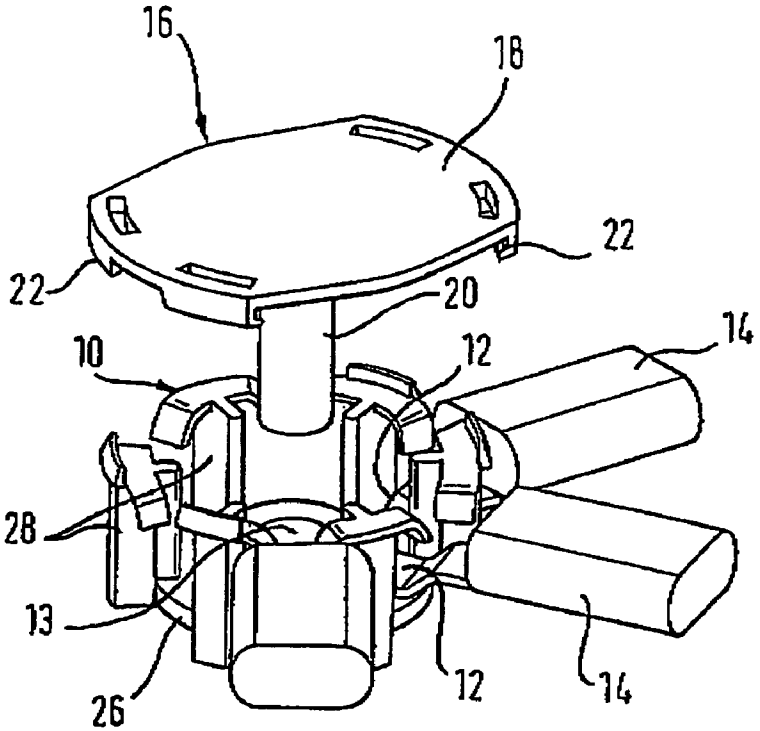

In the drawings:

FIG. 1 is an exploded view of a prearrangement according to a first embodiment of the present invention FIG. 2 is a perspective view of the prearrangement shown in FIG. 1

Figure 3:
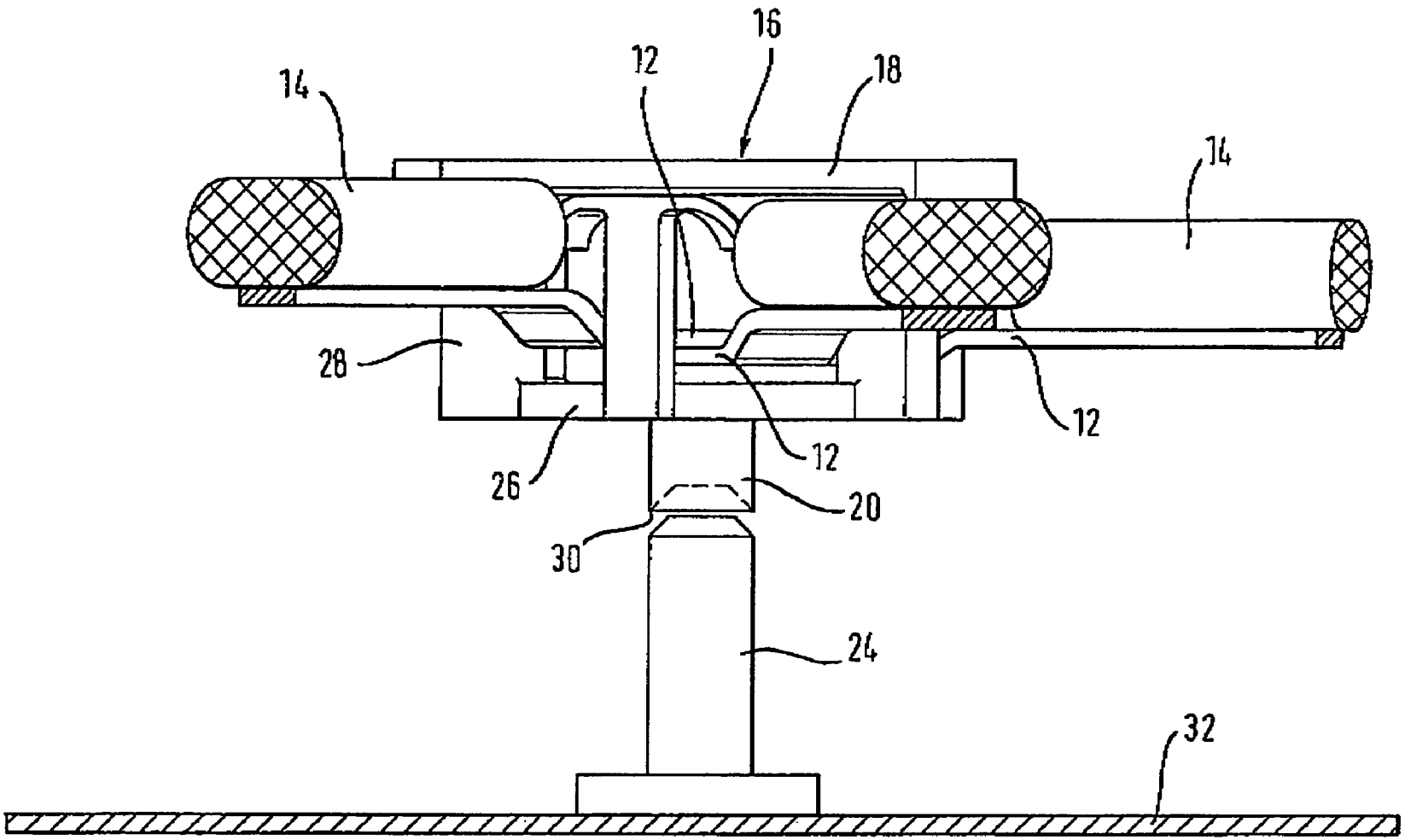
Figure 5:
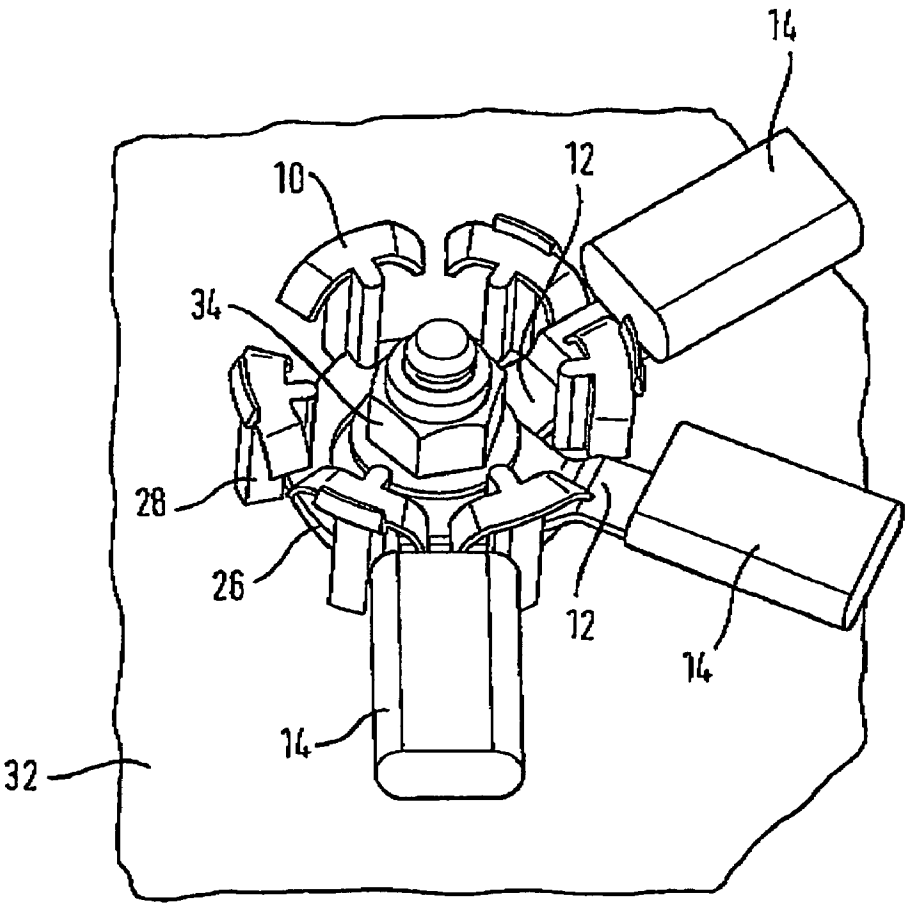
Figure 4:
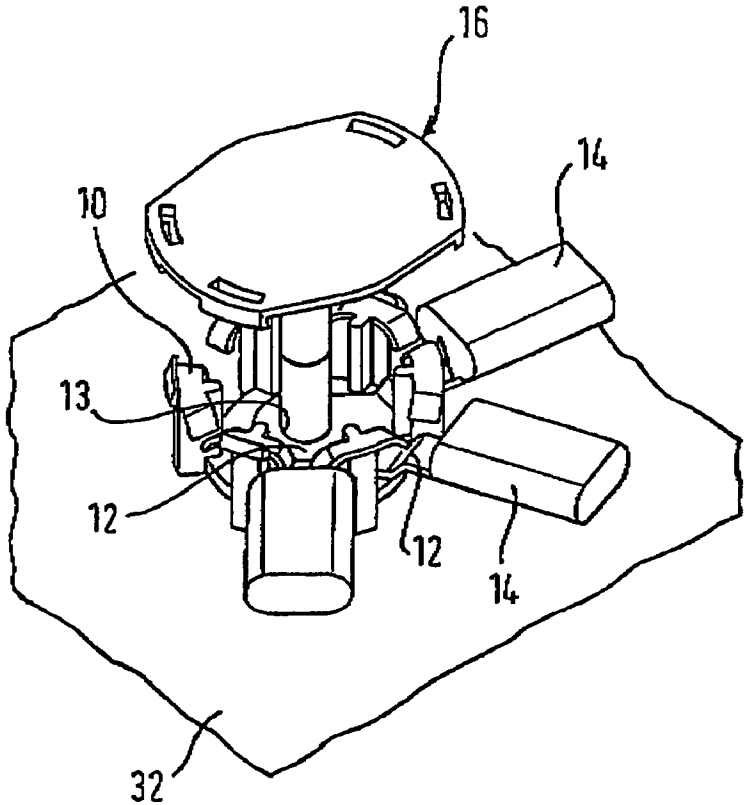
Figure 6:
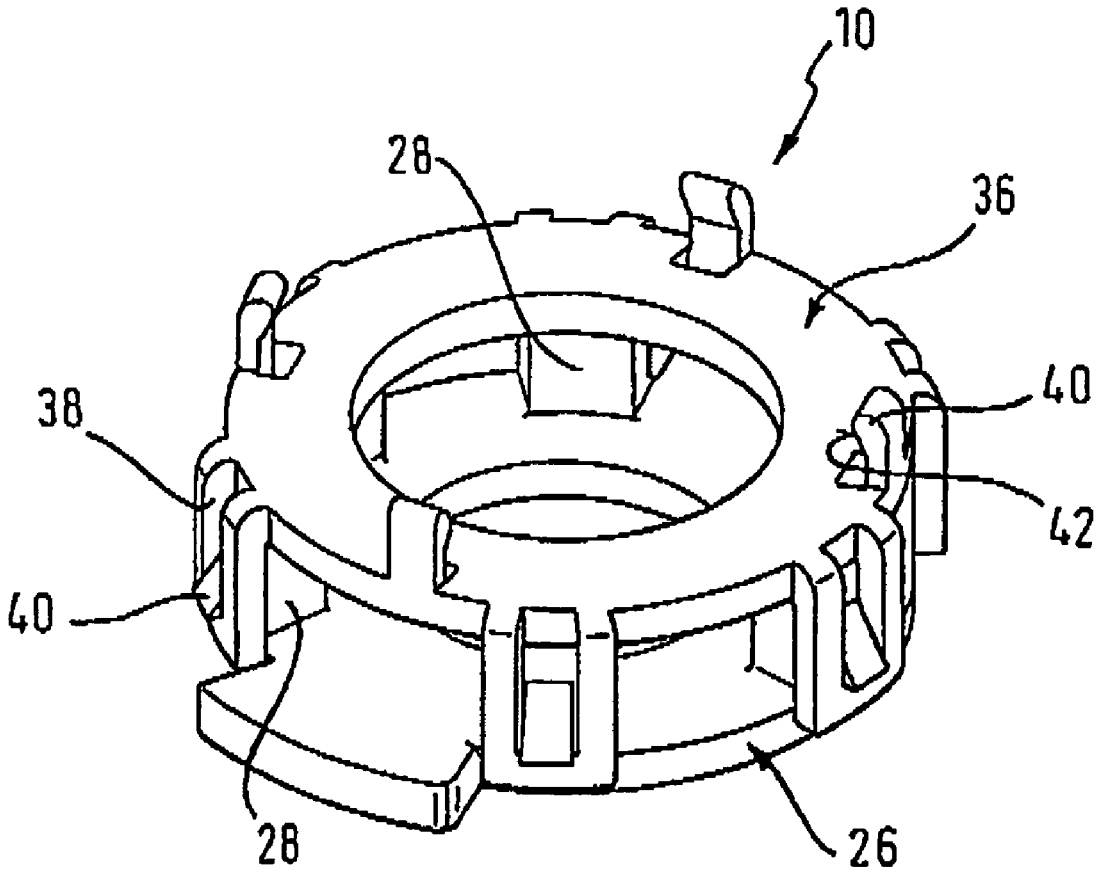
Figure 7:
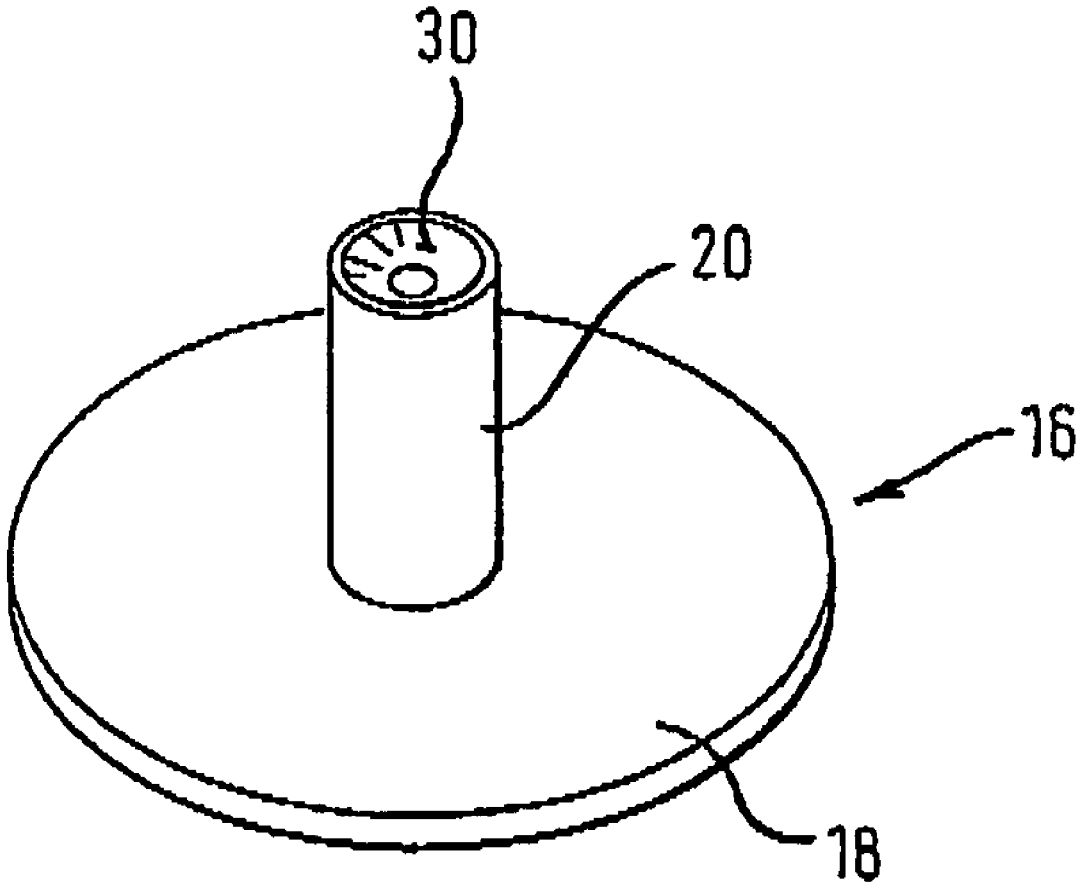
Figure 8:
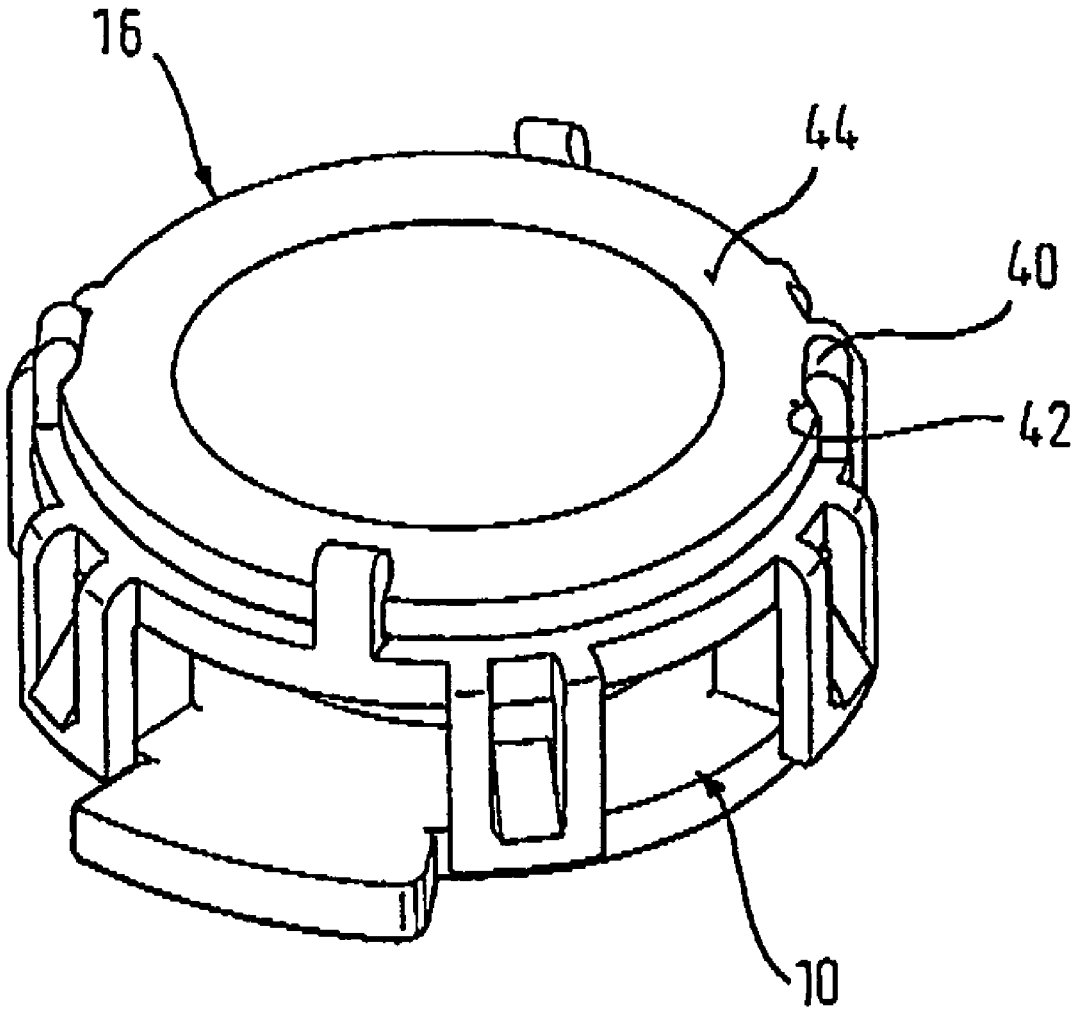
Figure 9:
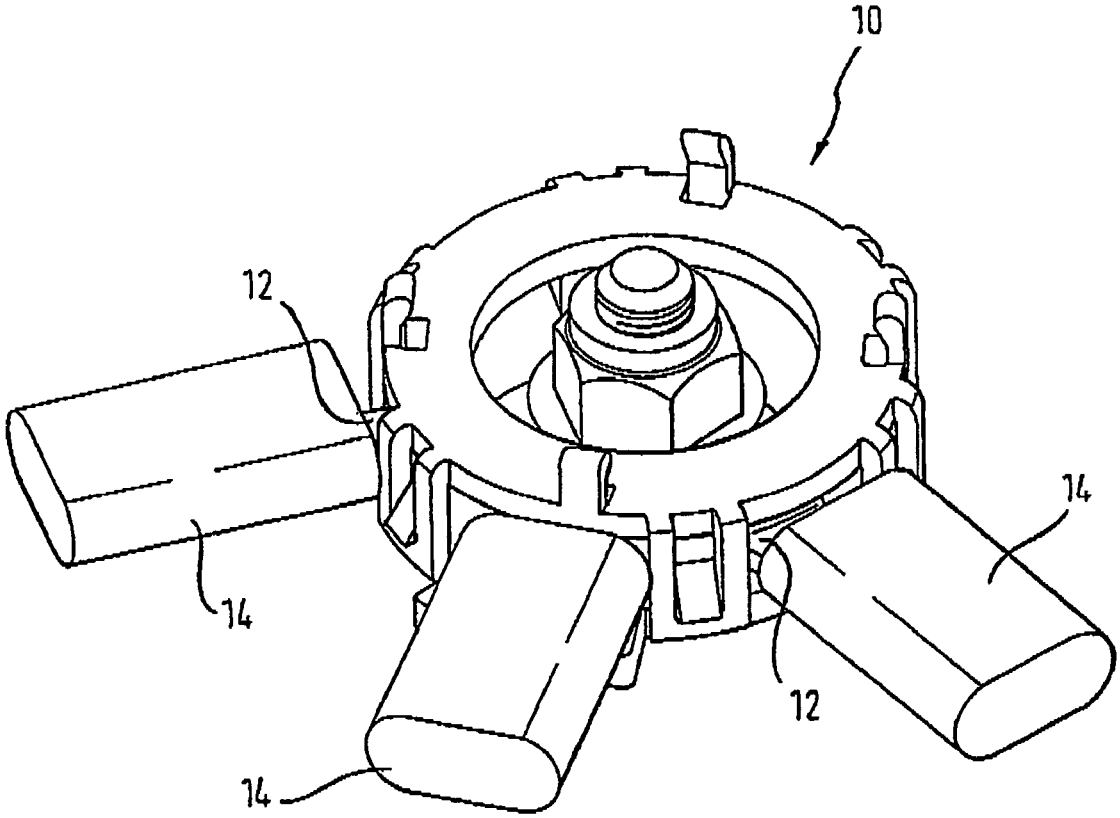

FIG. 3 is a side view of the prearrangement shown in FIG. 1 being placed on a retaining screw FIG. 4 is a perspective view of the prearrangement in FIG. 1 in which, with the prearrangement placed on a retaining screw, the distributor with the lugs has been pushed onto the screw FIG. 5 is a perspective view of lugs with a distributor mounted or screwed on the retaining screw FIG. 6 is a perspective view of a distributor according to a second example of an embodiment of the prearrangement in the present invention FIG. 7 is a perspective bottom view of a mounting aid for the second embodiment of the present invention FIG. 8 is a prearrangement according to a second embodiment of the present invention with the distributor from FIG. 6 and the mounting aid from FIG. 7 and FIG. 9 is a perspective view of lugs with the distributor in FIG. 6 screwed to the retaining screw.

DESCRIPTION OF EXAMPLES OF EMBODIMENTS

A first example of an embodiment of the present invention will be explained with reference to FIGS. 1 to 5.

FIGS. 1 and 2 show a prearrangement according to the present invention. The prearrangement comprises a distributor 10 and several lugs 12 (in the case of the present embodiment three in FIG. 1 four in FIG. 2). The lugs 12 have fixing holes with a circular cross section and are connected by an optional means of connection, e.g. a crimp connection, to an electrical cable 14. The fixing holes 13 in the lugs are, for example, visible in FIG. 4 or in FIG. 1.

In addition, the prearrangement according to the first embodiment of the present invention comprises a mounting aid 16. The mounting aid comprises a centring element 20 protruding from a basic element 18, which is firmly connected to the basic element 18. In addition, in the embodiment shown, snap-in fasteners 22 are provided on the basic element 18, which can be brought into engagement with the distributor 10, i.e. reach behind a corresponding edge of the distributor 10. The connection between the mounting aid 16 and the distributor 10 is detachable.

As is evident from FIG. 3 for example, the cross section of the centring element 20 corresponds to the cross section of the retaining screw 24. In addition, the centring element penetrates the fixing holes 13 in the lugs 12. The detachable fixing of the mounting aid 16 to the distributor 10 also prevents the lugs from slipping out of the distributor before mounting.

The distributor 10 also has a substantially circular basic element 26 with an opening or recess in its centre. Protruding from this basic element are separating elements 28 which define several passage openings, through which the lugs 12 pass. In the embodiment shown, one lug passes through each passage opening. In addition, the passage openings are sealed by the basic element, the separating elements and the mounting aid so that the lugs 12 are unable to slip out of the prearrangement. The centring element 20 also holds them in a radial direction.

The centring element 20 is also designed to protrude from the basic element 26 of the distributor 10. In the example of an embodiment shown, the end 30 of the centring element 20 facing the retaining screw 24 is embodied with an engagement section. This engagement section has an inner cone corresponding to the chamfer or the blunt outer cone of the retaining screw 24. The retaining screw 24 is, for example, welded onto a part of the motor vehicle body 32.

The following describes the mounting method by means of a prearrangement according to the first embodiment again with reference to FIGS. 1 to 5.

First, the lugs 12, which are connected to the cables in a cable tree, are inserted in the distributor 10 so that each passes through one of the passage openings. Then, the mounting aid 16 is fed through the aligned fixing holes 13 in all the lugs 12 and also passes through the hole provided in the basic element 26 of the distributor 10. The mounting aid 16 is connected in a detachable way by an interlocking device, for example, the snap-in fasteners 22, to the distributor 10. At this stage, the preliminary mounting is completed and the cable tree with the attached prearrangement is mounted in the motor vehicle on the (main) assembly line.

Here, as shown in FIG. 3, the prearrangement is placed on the retaining screw 24, where the inner cone 30 as an engaging element of the centring element 20 is brought into engagement with the retaining screw 24, in particular the outer cone of the retaining screw 24. If the prearrangement is placed on the retaining screw 24, the distributor 10 with the lugs 12 is moved in the direction of the mounting screw 24. During this process, the distributor and in particular the lugs 12 slide from the centring element 20 onto the retaining screw 24. In addition, preferably the snap-in fasteners 22 on the mounting aid or its interlocking device are designed so that the movement of the distributor with the lugs 12 in the direction of the retaining screw 24 or the vehicle body, i.e. a relative movement between the distributor and mounting aid, results in the detachment of the mounting aid from the distributor.

Then, the mounting aid 16 is removed from the retaining screw 24 and the lugs screwed onto the retaining screw 24 by means of a nut 34. The mounting process described with reference to FIGS. 4 and 5 relates to the final mounting of the lugs with the distributor on the retaining screw.

The following describes a second embodiment of the prearrangement according to the present invention with reference to FIGS. 6 to 9.

FIG. 6 is a perspective view of an alternative embodiment of a distributor 10. The distributor 10 comprises two elements, namely a basic element 26, with separating elements 28 provided thereon which define several passage openings. In addition, a sealing element 36 is provided. The sealing element 36 has engagement sections 38, which may be brought into engagement with locking hooks 40 on the basic element, in order to connect the sealing element 36 with the basic element 26. In addition, snap-in fasteners 40 are provided on the sealing element 36 which are intended to connect the mounting aid 16 detachably with the distributor. The snap-in fasteners 40 in this embodiment have an inclined stop surface 42 which reaches behind a similarly inclined stop surface on the mounting aid 16.

The mounting aid 16 for the second embodiment is shown in FIG. 7 and also has a basic element 18 and the centring pin firmly connected thereto or the centring element 20. In addition, FIG. 7 shows the inner cone in the centring element 20 on the end facing away from the basic element 18 or the end facing toward the retaining screw 24.

FIG. 8 shows the connection for connecting the mounting aid 16 to the distributor, whereby the lugs have been omitted in this representation. This shows how the inclined stop edge 42 of the snap-in fasteners 40 reaches behind the mounting aid 16 at four positions in order to connect it detachably with the distributor 10.

The mounting process for the lugs with the prearrangement according to the second embodiment of the present invention is substantially the same as that with the first embodiment.

However, the two-part design of the distributor simplifies the insertion of the lugs. Here, the lugs are first inserted in the basic element 26 between the separating elements 28. Next, the sealing element is positioned and latched to the basic element so that the passage openings are sealed. This provides pre-fixing and anti-twist protection for the lugs for simpler mounting on an earthing screw in the vehicle including after the removal of the mounting aid 16.

In addition, with the second embodiment it is clear (see FIG. 8) that when the distributor 10 is moved relative to the mounting aid 16 in the direction of the retaining screw 24, the inclined stop surface 42 of the snap-in fasteners 40 slides along the corresponding slope of the mounting aid 16 and the engagement of the snap-in fasteners 40 with the mounting aid 16 is released. This design means that no additional tool is necessary, instead the complete mounting may be performed by hand or manually.

FIG. 9 shows the final mounting position of the distributor 10 with the lugs 12 on a retaining screw 24. The mounting aid is removed in this case as well.

The above description of examples of embodiments is not intended to restrict the present invention. Consequently, various modifications and deviations from the embodiments are possible.

For example, it is possible for the cross section of the centring element 20 not to correspond exactly to the cross section of the retaining screw 24, but to be designed correspondingly larger, smaller or in a different shape. However, this is heavily dependent upon the design of the fixing holes 13 in the lugs 12, which may also have different designs from each other. In addition, the interlocking of the mounting aid 16 with the distributor 10 can take place in a different way and different variants of embodiments will be apparent to a person skilled in the art. Other variations of the distributor also appear conceivable.

The invention claimed is:

1. A prearrangement device for holding mounting lugs for subsequent mounting on a retaining screw, the prearrangement device comprising:

a distributor mountable on the retaining screw;

at least two lugs with a fixing hole, whereby the lugs are each inserted in the distributor in such a way that the fixing holes are substantially in alignment with each other; and a mounting aid slidably detachably connected to the distributor and having a protruding centering element which has a cross section substantially corresponding to the cross section of the retaining screw, said centering element passing through the fixing holes in the lugs, the mounting aid and the distributor cooperating to hold the lugs in a desired position, whereby the end of the centering element facing the retaining screw has an engagement section to be brought into engagement with the retaining screw, whereupon movement of the prearrangement device onto the retaining screw causes the centering element to move in a direction out from the fixing holes in the lugs so that the lugs can thereafter be mounted onto the retaining screw.

2. The prearrangement device according to claim 1, wherein the engagement section is an innercone.

3. The prearrangement device according to claim 1, with which the mounting aid has snap-in fasteners which may be brought into engagement with the distributor in order to connect the mounting aid detachably with the distributor.

4. The prearrangement device according to claim 1, in which the distributor has snap-in fasteners, which may be brought into engagement with the mounting aid in order to connect the mounting aid detachably with the distributor.

5. The prearrangement device according to claim 3, in which the snap-in fasteners have an inclined stop surface and the snap-in fasteners reach behind the mounting aid or the distributor in such a way that the snap-in fasteners are disengaged from the mounting aid or the distributor by the movement of the distributor relative to the mounting aid.

6. The prearrangement device according to claim 1, in which the mounting aid is an injection molded part.

7. The prearrangement device according to claim 1, in which the mounting aid is a re-usable part.

8. The prearrangement device according to claim 1, in which the distributor comprises a basic element on which several separating elements are provided to define passage openings.

9. The prearrangement device according to claim 8, in which the distributor comprises a sealing element which seals the passage openings on the side facing away from the basic element and is connected to the basic element.

10. The prearrangement device according to claim 9, in which the sealing element is connected to the basic element by means of a snap-in connection with the basic element.

11. The prearrangement device according to claim 9, in which the sealing element has the snap-in fasteners.

12. The prearrangement device according to claim 1, in which the distributor defines at least two passage openings separated from each other, whereby the at least two lugs each pass through one of the passage openings.

13. The prearrangement device according to claim 1, in which the fixing holes substantially correspond to the cross section of the retaining screw.

14. Cable tree with at least two lugs and a prearrangement according to claim 1.

15. A mounting aid for use in mounting lugs together with a distributor on a retaining screw, the mounting aid comprising:

a base;

a centering element connected to the base, a free end of the centering element having an engagement section to be brought into engagement with the retaining screw, the centering element having a cross section substantially corresponding to the cross section of the retaining screw; and an interlocking device coupled to the base and being constructed and arranged to slidably detachably connect the mounting aid with the distributor;

wherein, upon movement of the mounting aid together with the mounting lugs and the distributor onto the retaining screw, the centering element causes the interlocking device to detach the mounting aid from the distributor so that the lugs together with the distributor can thereafter be mounted onto the retaining screw.

16. The mounting aid according to claim 15, wherein the engagement section is an innercone.

17. The mounting aid according to claim 15, further comprising snap-in fasteners formed on the base, the snap-in fasteners being constructed and arranged to be engageable with the distributor to detachably connect the mounting aid to the distributor.

18. The mounting aid according to claim 15, in which the mounting aid is an injection molded part.

19. A method of mounting lugs on a retaining screw, the method comprising:

inserting at least two lugs in a distributor so that fixing holes in the lugs are substantially in alignment with each other, slidably detachably mounting a mounting aid with a centering element on the distributor so that the centering element passes through the fixing holes, positioning the distributor with the mounting aid and the lugs on the retaining screw, whereby the centering element engages with the retaining screw, pushing the lugs with the distributor from the centering element onto the retaining screw, whereby the mounting aid is released from the distributor, and fixing the lugs on the retaining screw.

20. A method for premounting mounting lugs on a prearrangement device for subsequent mounting of the mounting lugs on a retaining screw, the method comprising:

inserting at least two lugs in a distributor so that fixing holes in the lugs are substantially in alignment with each other, and slidably detachably mounting a mounting aid with a centering element on the distributor so that the centering element passes through the fixing holes.

21. A method for the final mounting of lugs on a retaining screw by means of a prearrangement having a mounting aid with a centering element which passes through fixing holes in the lugs, the method comprising:

positioning the prearrangement an the retaining screw, whereby the centering element engages with the retaining screw, pushing the lugs from the centering element onto the screw, and fixing the lugs on the retaining screw.

* * * * *